United States Patent [19]

Segura

[11] Patent Number: 4,546,966

[45] Date of Patent: Oct. 15, 1985

[54] BOXER TRAINING AID

[76] Inventor: Perfecto B. Segura, 1725 Anita Dr., Las Cruces, N. Mex. 88001

[21] Appl. No.: 618,348

[22] Filed: Jun. 7, 1984

[51] Int. Cl.[4] ..... A63B 69/00; A63B 69/34

[52] U.S. Cl. ..... 272/76

[58] Field of Search ..... 272/76–78; 273/55 A; 2/2; 5/425, 427

[56] References Cited

U.S. PATENT DOCUMENTS

| | | | |
|---|---|---|---|
| D. 169,243 | 4/1953 | Doherty | 272/76 |
| 2,203,259 | 6/1940 | Gilman . | |
| 2,526,217 | 10/1950 | Gilman . | |
| 2,574,046 | 11/1951 | Logan . | |
| 2,904,337 | 9/1959 | Canning . | |
| 2,994,534 | 8/1961 | Davis et al. . | |
| 3,250,533 | 5/1966 | Nicholson | 272/76 |
| 3,476,107 | 11/1969 | Matt, Jr. et al. . | |
| 3,700,237 | 10/1972 | Kopp | 273/55 A |
| 3,759,515 | 9/1973 | Crooks . | |
| 3,927,879 | 12/1975 | Long . | |
| 4,108,428 | 8/1978 | Winterbottom . | |
| 4,345,755 | 8/1982 | Eidson | 272/78 |
| 4,434,980 | 3/1984 | Babineaux | 272/78 |

FOREIGN PATENT DOCUMENTS

| | | | |
|---|---|---|---|
| 0516092 | 12/1920 | France | 272/77 |
| 0710555 | 1/1978 | U.S.S.R. | 272/76 |

OTHER PUBLICATIONS

*Black Belt* Magazine 2/84, p. 7, Shodun Apartment Sparring Mate.

*Black Belt* Magazine 3/1979, p. 25, e.g. Air Shield-/Curved Striking Pad.

*Primary Examiner*—Richard J. Apley

*Assistant Examiner*—Kathleen D'Arrigo

*Attorney, Agent, or Firm*—Cushman, Darby & Cushman

[57] ABSTRACT

A sparring partner who may be a trainer or another boxer dons and grasps a novel boxer training aid in the form of a padded plate. The plate has a torso-conforming forwardly moderately-convex central portion, flanked at the sides and top with obliquely forwardly projecting wings which have a tendency to focus the boxer's blows on the central portion. A fairly narrow slot is provided between the two padded wings at the top, so that the sparring partner may observe the boxer's technique in close proximity to the body, without risk of receiving a blow to the head. By preference the padded plate is worn by use of a set of bandolier-like straps, and held by use of a pair of handles secured on the backs of the side wings.

10 Claims, 8 Drawing Figures

BOXER TRAINING AID

BACKGROUND OF THE INVENTION

In the course of training for a boxing match, and in the course of practicing to improve boxing skills, an important and major activity is actually sparring with another person, typically a boxer of comparable skill, or comparable weight and reach, sometimes a more skilled boxer or a trainer.

The most difficult part of sparring is to give the training or practicing boxer a realistic workout or at least an effective one that works towards improving skills, displaying them, or highlighting a technique that is in need of change or improvement, without unduly risking injury to the boxer or the sparring partner.

For a boxer, to spar has meant to rlsk injury at a moment when no title, prize or record is at stake, and, perhaps not only to become injured, but as a result to have to postpone or forego a match or other opportunity.

For a trainer, all too often the risk is so great that the trainer's observations and corrections to the boxer's technique must be offered from the perspective of a bystander, rather than from the perspective of a sparring partner. Particularly where the trainer's objectives are to keep a boxer's punches short and to prevent the boxer from punching to the outside, providing instruction as an observer or even as a participant in conventional sparring has been less than satisfactory.

A tendency in the past has been to attempt to replace a certain amount of sparring against a live partner, with practicing of punching against punching bags or other static or reactive mechanical targets. Although some of that type of practice no doubt is helpful, it gives the boxer a lesser sense of the vitality of an opponent. In short, the boxer misses out on refinement of his ability to effectively direct his punches at a mobile opponent when he is practicing against a static or merely reactive target.

SUMMARY OF THE INVENTION

A sparring partner who may be a trainer or another boxer dons and grasps a novel boxer training aid in the form of a padded plate. The plate has a torso-conforming forwardly moderately-convex central portion, flanked at the sides and top with obliquely forwardly projecting wings which have a tendency to focus the boxer's blows on the central portion. A fairly narrow slot is provided between the two padded wings at the top, so that the sparring partner may observe the boxer's technique in close proximity to the body, without risk of receiving a blow to the head. By preference the padded plate is worn by use of a set of bandolier-like straps, and held by use of a pair of handles secured on the backs of the side wings.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
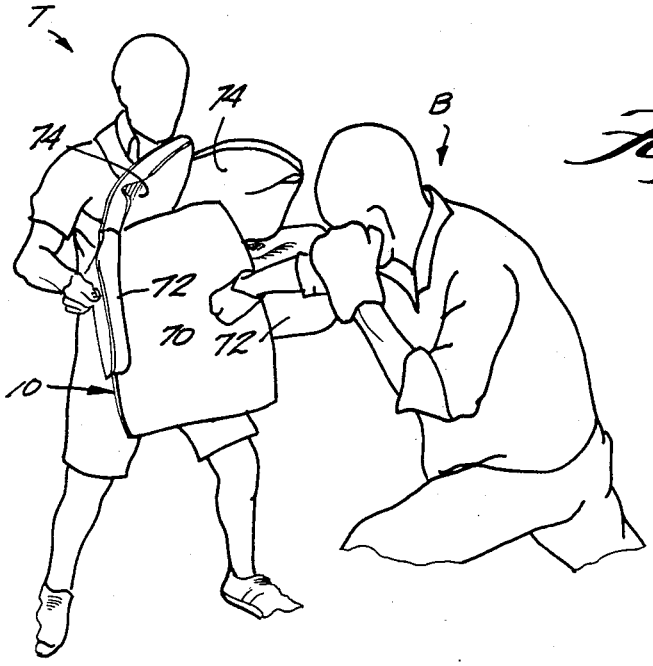
FIG. 1 is a perspective view of a boxer training aid provided in accordance with the principles of the present invention, being worn and moved by a trainer as a boxer spars against it, throwing a right straight punch.

The boxer training aid 10 of the present invention is a device which resembles a cross between a baseball umpire's chest protector and the upper part of an upholstered arm chair.

In the preferred embodiment, the boxer training aid comprises a shell, frame or plate portion 12, which may be made of lightweight metal plate, e.g., aluminum or aluminum alloy such as is conventionally used in the manufacture of ladders, or of glass fiber-reinforced plastic such as is conventionally used in the manufacture of boat hulls, snow skis, police riot shields and the like. Typically, the frame 12 is about one-eighth of an inch thick and is either made in one piece, or is assembled together out of several pieces, using conventional techniques such as brazing, welding, the use of fasteners, solvent welding in the case of plastics, or the like.

The frame 12 is seen to include a central portion 14 in the form of a forwardly convex, generally cylindrically curved plate, curved about a generally upright axis. The central portion 14 typically is about two feet high (all dimensions being given herein for non-limiting, illustrative purposes only), so that in use it will extend from approximately mid-chest down to about mid-thigh of the wearer. Typically the central portion is about one and a half feet wide, being curved to generally conform to the front of the wearer and to extend generally fully across the front of the wearer.

The central portion 14 is shown being generally apron-shaped in outline, with a generally horizontal lower margin 16 meeting generally vertical left and right lateral margins 18 at rounded corners 20. Somewhat over half-way up the central portion 14, its lateral margins 18 angle obliquely upwards towards the center at 22 so that at the horizontal upper margin 24, the central portion 14 is about eight inches across.

Along approximately the middle third of the lateral margins, the central portion 14 is provided with side wings 26, each typically somewhat less than a foot in height and angled so that they joint the lateral margins at almost right angles and enclose about forty-five degrees between them, i.e. an angle less than a right angle due to the convexity of the central portion 14.

In the embodiment shown, the side wings 26 are generally rectangular and planar, except that they curve inwards in their upper marginal regions 28 coinciding with the apices 22 of the lateral margins of the central portion 14. The upper and lower outer corners are rounded at 30, 32.

Figure 4:
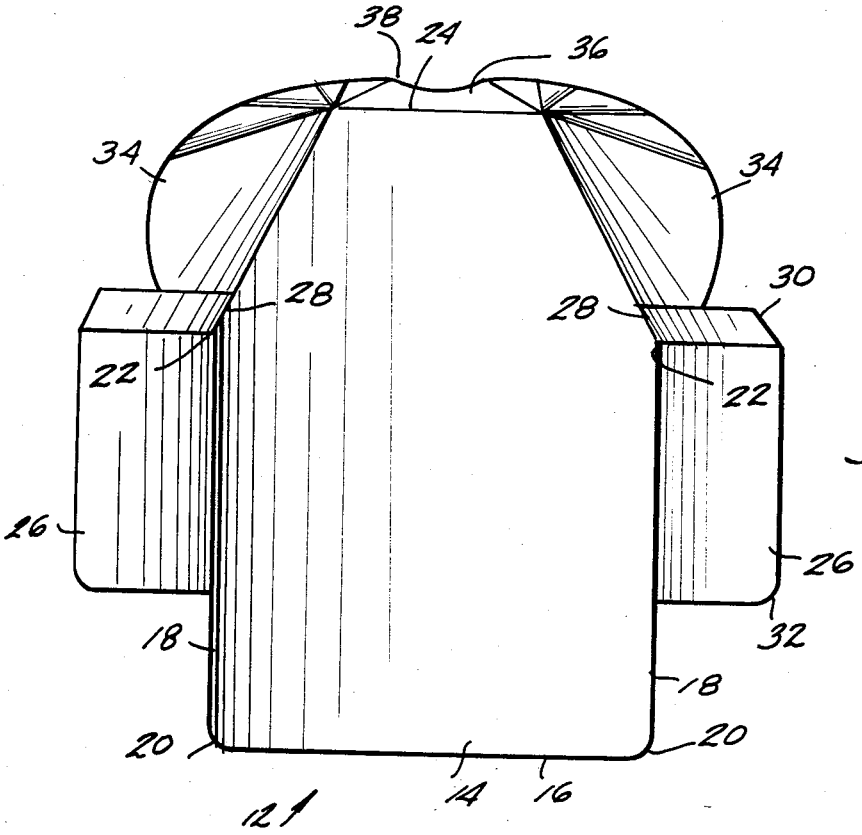
FIG. 4 is a rear elevation view of the shell of the boxer training aid.
Figure 5:
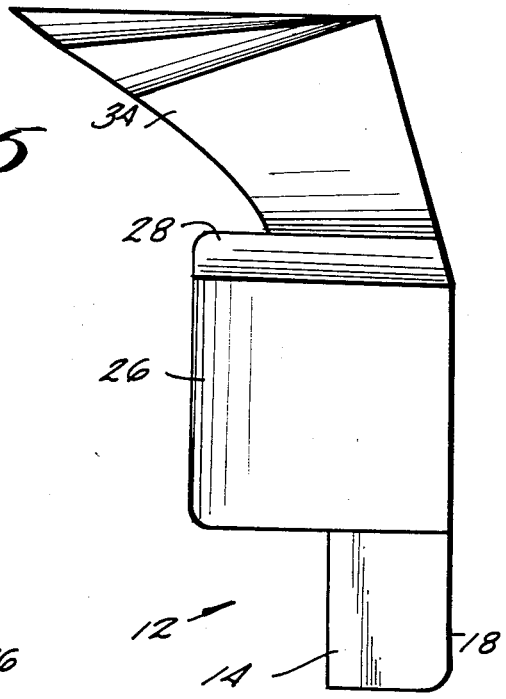
FIG. 5 is a side elevational view of that shell.
Figure 6:
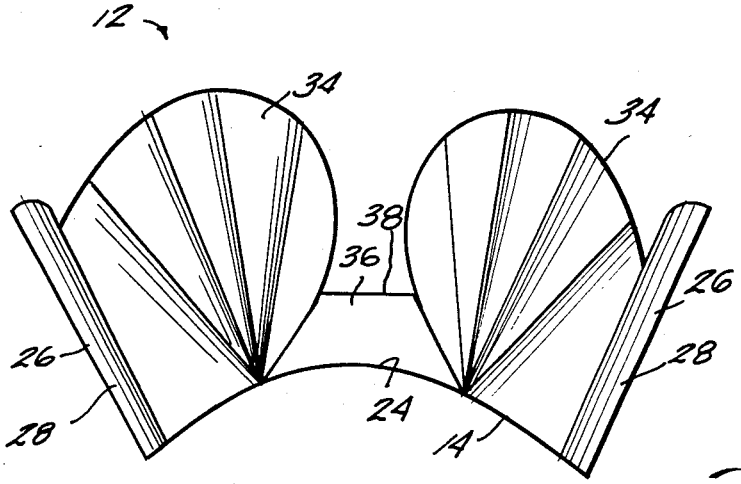
FIG. 6 is a top plan view thereof.
Figure 7:
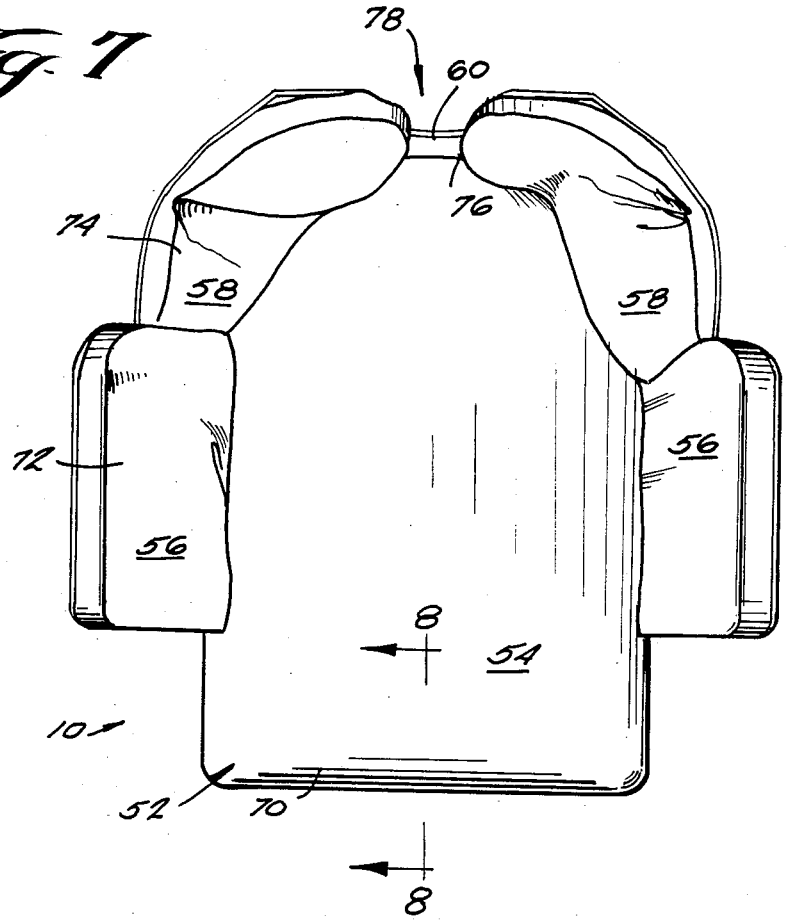
FIG. 7 is a front elevational view of the boxer training aid.
Figure 8:
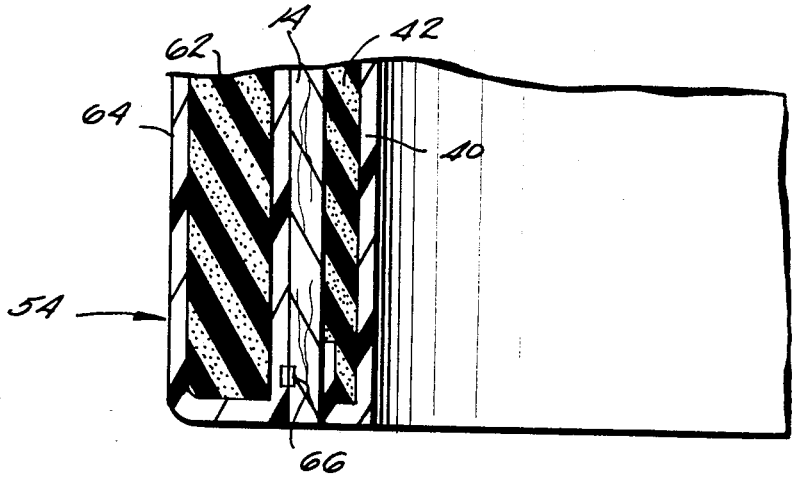
FIG. 8 is a fragmentary sectional view on line 8—8 of FIG. 7.

From the upper margins 28 of the side wings 26, along approximately the upper third of the lateral margins 18, to the upper margin 24, the central portion 14 is flanked and topped by left and right upper wings 34. These elements are compoundcurved structures which generally form a canopy or arch that curves from the upper margin 28 of one side wing 26 up, over, and down to the upper margin 28 of the other side wing 26. In this regard, it should be noted that each upper wing 34 is distinct in profile from each side wing 26, and that, at the top of the arch the left and right upper wings 34 are separated laterally from one another by a medially located transitional wing structure 36 which is visually distinct from both of them and has a substantially lesser amount of forward projection. For instance, each upper wing 34 is generally a rounded outer edge, fan-shaped structure having a maximum forward projection of somewhat more than one foot, cutting back to about eight inches in forward projection where it joins the respective side wing 26 and to about four inches in forward projection where it joins the end of the respective transitional wing structure 36. The latter structure is shown medially provided with an upwardly concave profile as seen in rear elevation (FIG. 4). The fan-shaped nature of the profile of the upper wings 34 causes the front edge of the transition wing structure 36 to be about three to four inches across and the closest approach of the top wings to one another being about three inches, somewhat forwardly of the front edge 38 of the transitional wing structure 36.

The frame 12 typically is covered at least on its rear surface and on its leading edges with vinyl plastic-coated fabric 40, e.g. such as is used as artificial leather in the upholstering of chairs. It may be secured in place using the same type of adhesive as is used with such vinyl sheeting chair upholstering art. On the rear of the central portion 14 of the frame 12, preferably between the vinyl upholstery and the frame, there is shown interposed a padding 42, which may be cotton batting or felt, or foamed plastic e.g. flexible polyurethane such as is used as padding in the manufacture of upholstered furniture such as recliner chairs.

For supporting and carrying the boxer training aid 10, the vinyl-covered frame 12 is shown provided with a pair of bail-like handles 44 mounted in generally horizontal dispositions about half-way up the frame 12 on the rear of the respective side wings 26, and two pairs of smaller, bail-like strap anchors 46, 48 mounted on the rear of the respective upper wings 34 near the junctures with the central portion 14, respectively near the respective side wing and the respective end of the transitional wing structure 36. One length of fabric webbing 50, such as is conventionally used for making automotive seat belts is looped between the left strap anchor 46 and the right strap anchor 48, and another is looped between the right strap anchor 46 and the left strap anchor 48 so as to provide two bandolier-type of straps on the back of the frame 12.

Accordingly, the person who is to wear or carry the boxer training aid may pick it up, and slip his arms through opposite openings between the straps so that it becomes supported on his shoulders and displayed on the front of his torso. The handles 44 are then grasped partly to carry a selective amount of the weight of the device, partly to keep the device from being displaced from its torso-front covering position, and partly to ensure that as the wearer bobs and twists that the device will correspondingly move or move as desired and present an appropriately firm target.

The boxer training aid 10 is completed by frontal padding 52. By preference, the frontal padding 52 is provided as six distinct pillow-like bodies including a body 54 covering the front of the frame central portion 14, two bodies 56 covering the fronts of the respective side wings 26, two bodies 58 covering the fronts (i.e. inner, under sides) of the respective upper wings 34, and a body 60 covering the front (i.e. the inner, under side) of the transitional wing structure 36.

Each pillow-like body of padding 54–60 preferably includes a core 62 of cotton batting, felt and/or synthetic foamed plastic material such as is used in upholstering furniture, e.g. flexible polyurethane foam, preferably covers all of the respective elements of the frame, leaves no gaps between pillow-like bodies covering adjoining frame elements, and includes a covering 64, e.g. of vinyl upholstery material, leather, canvas or the like. The padding 62 typically is about one to two inches thick.

Suitable means are provided for individually, removably mounting the pillow-like bodies of padding 54–60 to the respective elements of the frame, e.g. a system of a plurality of upholstery snap fasteners 66 may be used between the backs of the padding bodies and the fronts of the frame elements. Other equivalent fasteners such as Velcro hook and fleece fasteners may be used.

Figure 2:
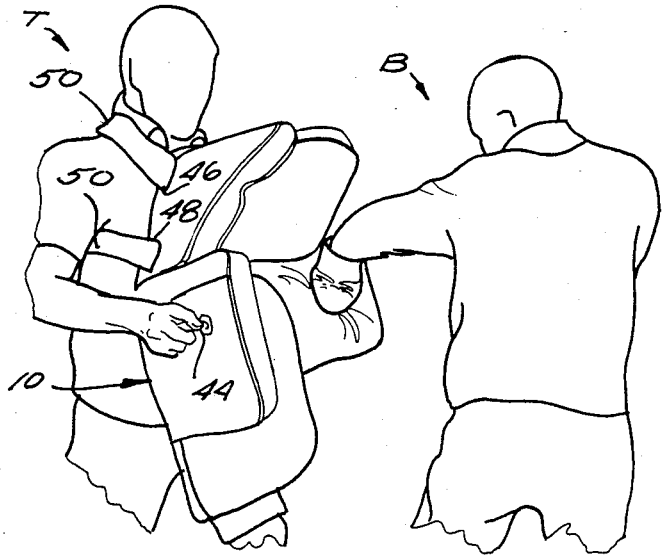
FIG. 2 is a similar perspective view showing a left hook or jab being trapped by a side wing from going wild outside.
Figure 3:
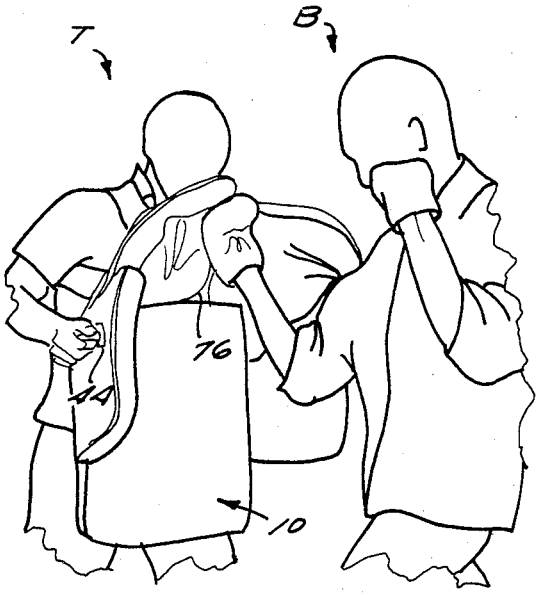
FIG. 3 is a similar perspective view showing a right upper cut being safely and closely observed by the trainer as it impacts a top wing of the boxer training aid.

The result is to provide a boxer training aid 10, the typical use of which is illustrated in FIGS. 1–3. Here, the boxer training aid is being shown as worn by a trainer T, while a boxer B engages in sparring. The central portion 70 is positioned as a target for all inside blows to the body, the side portions 72 are positioned to prevent wild outside blows from missing altogether, and the upper portions 74 are positioned to intercept uppercuts, as is the central transitional portion 76. The narrow upper central gap 78 which is provided between the upper portions 74 permits the trainer to view the boxer's gloved fists in close without being in danger of receiving a blow to the head. The upper wings are positioned just low enough that even when the boxer hits them with uppercuts, they will not slam into the partner's head. Of course, the support straps for the device 10 can be adjusted to provide the desired position of the device on the wearer.

Typically, the device 10 weighs 15–20 pounds.

Once attached to the target trainer or boxer, the device 10 provides a moving target for the opposing boxer. The opposing boxer gains the experience of body punching and straight punching in addition to throwing hooks, jabs and uppercuts at a moving target. The design of the device 10 restricts punches to the inside. The target wearer, when he is another boxer in training, while being protected, gains the experience of watching for the various punches coming, and reacting to and avoiding punches to the various target areas. Both the target wearer and the opposing boxer gain the benefit of improving their footwork.

Because the target areas are individually padded, the pads may be individually replaced as they become torn, worn or compacted, so that the overall device 10 will have an indefinitely long life and thus prove to be economical.

It should now be apparent that the boxer training aid as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A boxer training aid, comprising:

a strong and stiff frame including a central portion constructed and arranged to frontally cover a wearer's torso at least from about mid-chest height down to about mid-thigh height, a pair of opposite side wing portions which project obliquely forwardly along generally vertical opposite lateral margins of said central portion approximately a middle third of the height of said central portion, and a pair of opposite upper wing portions which project forwardly and face downwardly along upper margins of said central portion; said upper wing portions being arranged so close to one another centrally of the upper margins of the central portion that a boxing gloved fist cannot fit between them while delivering an uppercut during use of the boxer training aid;

support means for mounting said frame on the torso of a target wearer;

hand-grip means provided on the rear of said frame for being gripped by the target wearer for regulating side-to-side and angular movement of the frame relative to the target wearer's torso; and resilient padding body means provided frontally on said frame so as to frontally cover each of said portions thereof, so that an opposing boxer may practice punching the targeted wearer.

2. The boxer training aid of claim 1, wherein:

the frame is made of fiber-reinforced plastic.

3. The boxer training aid of claim 1, wherein: the frame is made of fiberglass material.

4. The boxer training aid of claim 1, wherein:

the upper margins of said central portion of said frame include a pair of lower segments which extend obliquely upwards toward one another and an upper generally horizontal central segment which both share in common.

5. The boxer training aid of claim 4, wherein:

a relatively short transitional wing portion is provided along said upper generally horizontal central segment of said upper margins of said central portion of said frame; said transitional wing portion extending between and joining said upper wing portions, but extending substantially less further forwards, so as to provide for a viewing gap between said upper wing portions.

6. The boxer training aid of claim 5, wherein:

said resilient padding body means is provided as a plurality of individual padding bodies separately mounted to said frame, with each padding body covering a respective said portion of said frame.

7. The boxer training aid of claim 4, wherein:

said resilient padding body means is provided as a plurality of individual padding bodies separately mounted to said frame, with each padding body covering a respective said portion of said frame.

8. The boxer training aid of claim 7, wherein:

each padding body comprises a core of resilient padding material; a covering of upholstery; and securement means for mounting the padding body to a respective portion of said frame.

9. The boxer training aid of claim 8, wherein:

each of said securement means is constructed and arranged for removably securing the respective padding body on the frame.

10. The boxer training aid of claim 1, wherein:

said central portion of said frame is generally cylindrically curved about a generally vertical axis so as to be forwardly convex.

* * * * *